US005759093A

United States Patent [19]

Rodriguez

[11] Patent Number: 5,759,093

[45] Date of Patent: Jun. 2, 1998

[54] ELECTRIC OSCILLATING ABRASIVE FILE

[76] Inventor: John Rodriguez, 357 Otono Crt., Camarillo, Calif. 93012

[21] Appl. No.: 705,171

[22] Filed: Aug. 29, 1996

[51] Int. Cl.[6] ..... B24B 23/04

[52] U.S. Cl. ..... 451/356; 132/73.6; 132/75.6; 451/163; 451/164

[58] Field of Search ..... 30/277.4; 132/73.6, 132/75.6, 75.8, 76.5; 451/163, 164, 356, 557

[56] References Cited

U.S. PATENT DOCUMENTS

| | | | |
|---|---|---|---|
| 935,350 | 9/1909 | Badge et al. | 451/557 |
| 1,014,594 | 1/1912 | Hankins | 132/73.6 X |
| 1,988,581 | 1/1935 | Ubelhart et al. | 132/73.6 |
| 2,163,018 | 6/1939 | Bernier | 451/356 X |
| 2,180,244 | 11/1939 | Kosterman | 30/277.4 |
| 2,519,687 | 8/1950 | Miller | 451/557 |
| 2,880,737 | 4/1959 | Tone et al. | 132/73.6 |
| 3,650,029 | 3/1972 | Trelc | 30/277.4 |
| 4,128,970 | 12/1978 | Sawrenko | 451/356 |
| 4,490,885 | 1/1985 | Iskiw et al. | 30/277.4 X |
| 5,033,485 | 7/1991 | Hauerwas et al. | 132/73.6 |

*Primary Examiner*—Timothy V. Eley
*Attorney, Agent, or Firm*—Edgar W. Averill, Jr.

[57] ABSTRACT

An electric reciprocating file or polishing member held in a housing. The housing supports a motor for reciprocating an enclosure held within the housing. A spring is held within the enclosure and the file is shaped to be snapped in or pulled out of the spring for use.

9 Claims, 4 Drawing Sheets

14

15
18
14
14

16
12
10
15
18
19
11
20
13
TO AC/DC 15
19
17
20

ELECTRIC OSCILLATING ABRASIVE FILE

BACKGROUND OF THE INVENTION

The field of the invention is electric tools and the invention relates more particularly to tools for shaping and polishing objects and even more particularly to nail file and nail polishing devices.

Electric nail files of various designs have been devised but none have found widespread use. One such nail file is shown in U.S. Pat. No. 2,880,737 where an abrasive member is held onto an reciprocating arm and used for filing fingernails. The device permits filing only on one side of the abrasive member and the abrasive member is held on the reciprocating arm by a pair of protruding clips which could cause damage to the nails.

U.S. Pat. No. 2,935,072 shows a manicuring device which has a metal abrasive file with an opening 11 at the inner end thereof. The metal file is permanently held within the device and thus, the device does not permit the changing of files for heavier or finer filing or for polishing.

In U.S. Pat. No. 5,033,485, the fingernail shaft 19 has a hole near its inner end which is held on a pin in a link which has another pin which is held to an reciprocating arm. It appears that the file would actually abrade on the housing and is not easily changed.

Lastly, U.S. Pat. No. 5,465,740 shows a battery operated nail file with a metal nail file which is held in the tool by a pair of upstanding hooks 76. The removal and replacement of the nail file appears difficult and the device has a large number of parts which would make it expensive to fabricate.

Because a shaping operation, and particularly a nail filing operation, requires a large number of files of different coarseness and fineness, including smooth polishing files, it should be very easy to insert and remove abrasive members from the electric abrasive file. The file should have few parts and be of durable construction so that it can be economically fabricated and have a reasonable service life.

BRIEF SUMMARY OF THE INVENTION

It is an object of the present invention to provide an electric abrasive file which permits the easy insertion and removal of abrasive members into and out of the unit. The present invention is for an electric abrasive file having a housing which includes a handle which housing supports an electric motor driving an reciprocating member. The housing includes an enclosure support cavity with an external opening at a file end of the housing. A clip support enclosure is slidingly held in the enclosure support cavity and is reciprocating by the reciprocating member. A generally U-shaped spring clip is held by the clip support enclosure and has a pair of arms facing an open end of the clip support enclosure. A file has an inner end and two sides, a top surface and a bottom surface and the inner end is shaped to be inserted into and removed from the U-shaped spring clip. Thus, numerous different files may be provided and any of them easily snapped into the unit and used. The file is equally easily pulled out of the unit. Since the abrasive file is held within an enclosure there is no abrasion between the housing and the abrasive unit.

DESCRIPTION OF THE PREFERRED EMBODIMENTS

Figures 1, 2, 3, 4, 5:
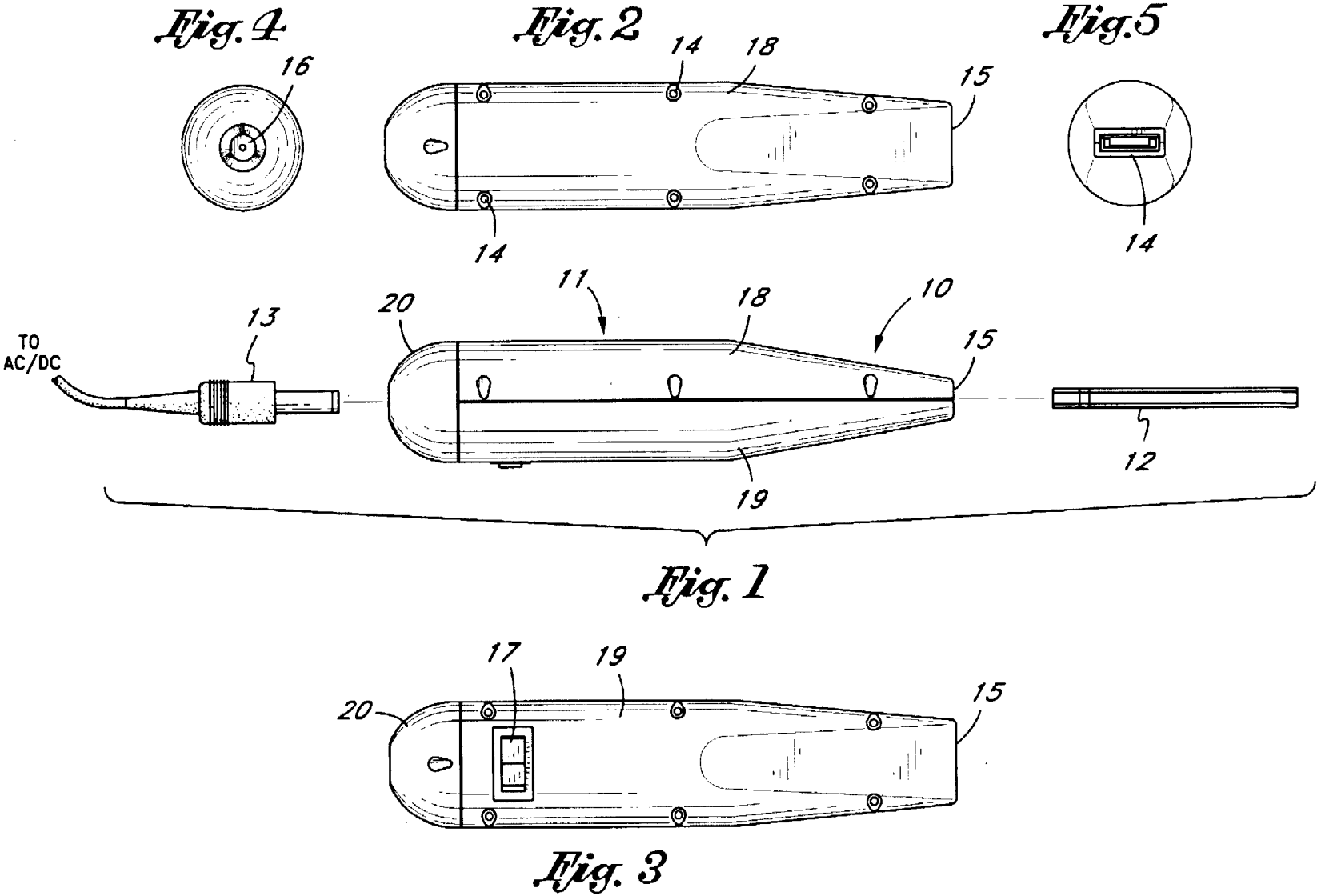
FIG. 1 is an exploded side view of the electric abrasive file of the present invention.
FIG. 2 is a top view thereof.
FIG. 3 is a bottom view thereof.
FIG. 4 is a rear view thereof.
FIG. 5 is a front view thereof.

The electric abrasive file of the present invention is shown in exploded side view in FIG. 1 and indicated generally by reference character 10. File 10 has a housing 11, a removable file 12 and a source of electricity comprising a plug 13. File 10 is shown in top view in FIG. 2 where fasteners 14 may be seen. The file housing 11 is preferably tapered inwardly to a file end 15. File end 15 has an opening for insertion of removable file 12 which will be described in more detail below. Plug 13 fits over a pin 16 which is conventional. Preferably the device may be operated with a conventional converter plugged into a normal housing electrical outlet. The housing 11 is shown in bottom view in FIG. 3 where a rocker switch 17 may be seen to easily turn on and off the electric abrasive file 10.

Figure 6:
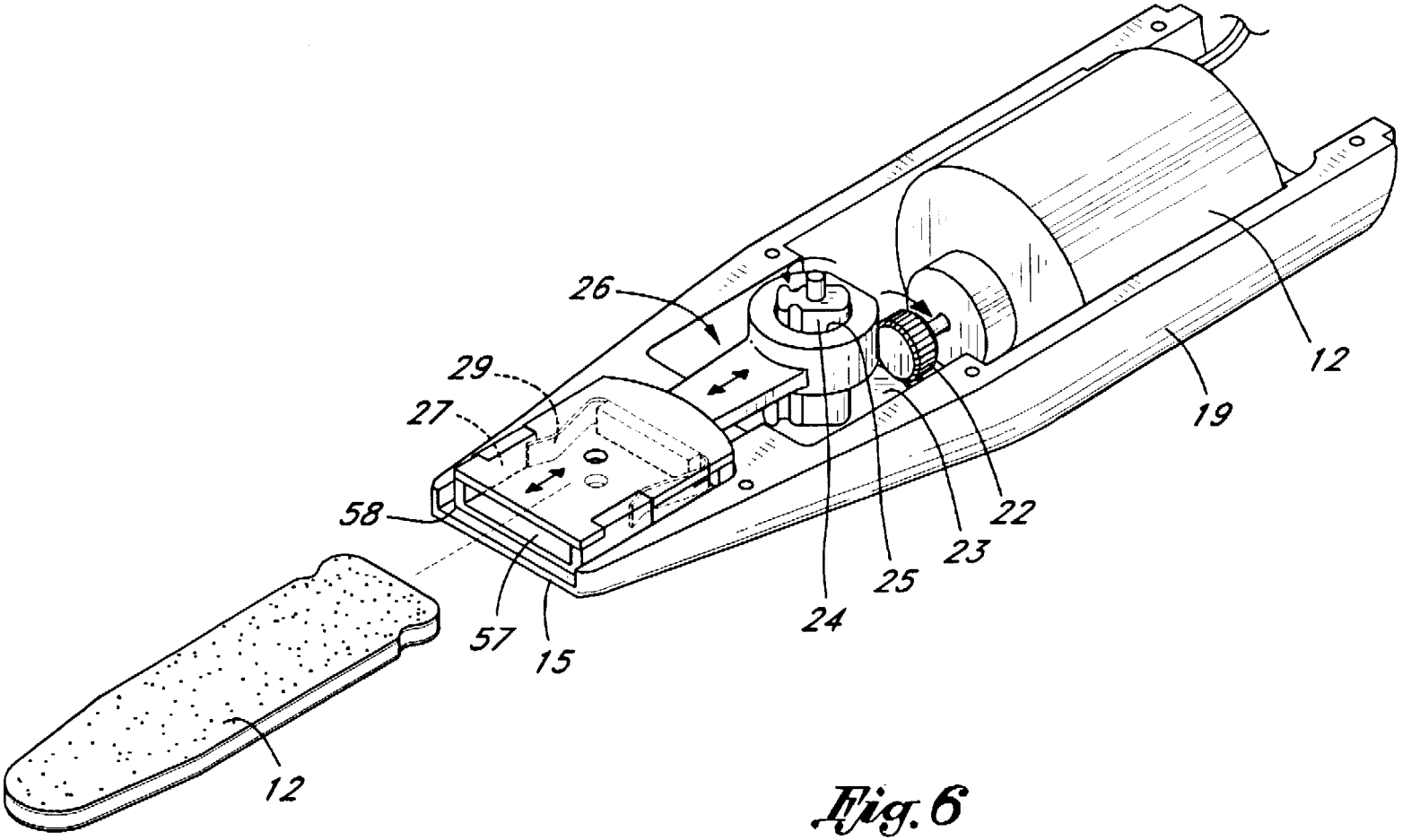
FIG. 6 is an exploded perspective view of the lower half of the housing and showing the internal portions of the file of FIG. 1.

Housing 11 can be seen to have an upper housing part 18, a lower housing part 19 and an end cap 20. The lower housing part 19 is shown in FIG. 6 where it can be seen that a cavity therein supports an electric motor 21. Electric motor 21 turns a spur gear 22. Spur gear 22 rotates ring gear 23 which in turn supports eccentric pin 24. Eccentric pin 24 is held within a cylindrical opening 25 in reciprocating member 26. Reciprocating member 26 reciprocates clip support enclosure 27. Clip support enclosure 27 is slidingly held in a generally rectangular shaped cavity 28 the bottom half of which is shown best in FIG. 7. Clip support enclosure 27 is preferably fabricated from a polymer such as that sold under the trademark "Teflon", nylon or other polymer which exhibits a low co-efficient of friction with generally rectangular shaped cavity 28. In this way, the device need not be lubricated as the polymer from which enclosure 27 is fabricated provides sufficient lubrication in combination with the polymer from which the housing is fabricated. It is anticipated that the housing would be made from polyvinyl chloride or other polymer having relatively high strength.

Figure 7:
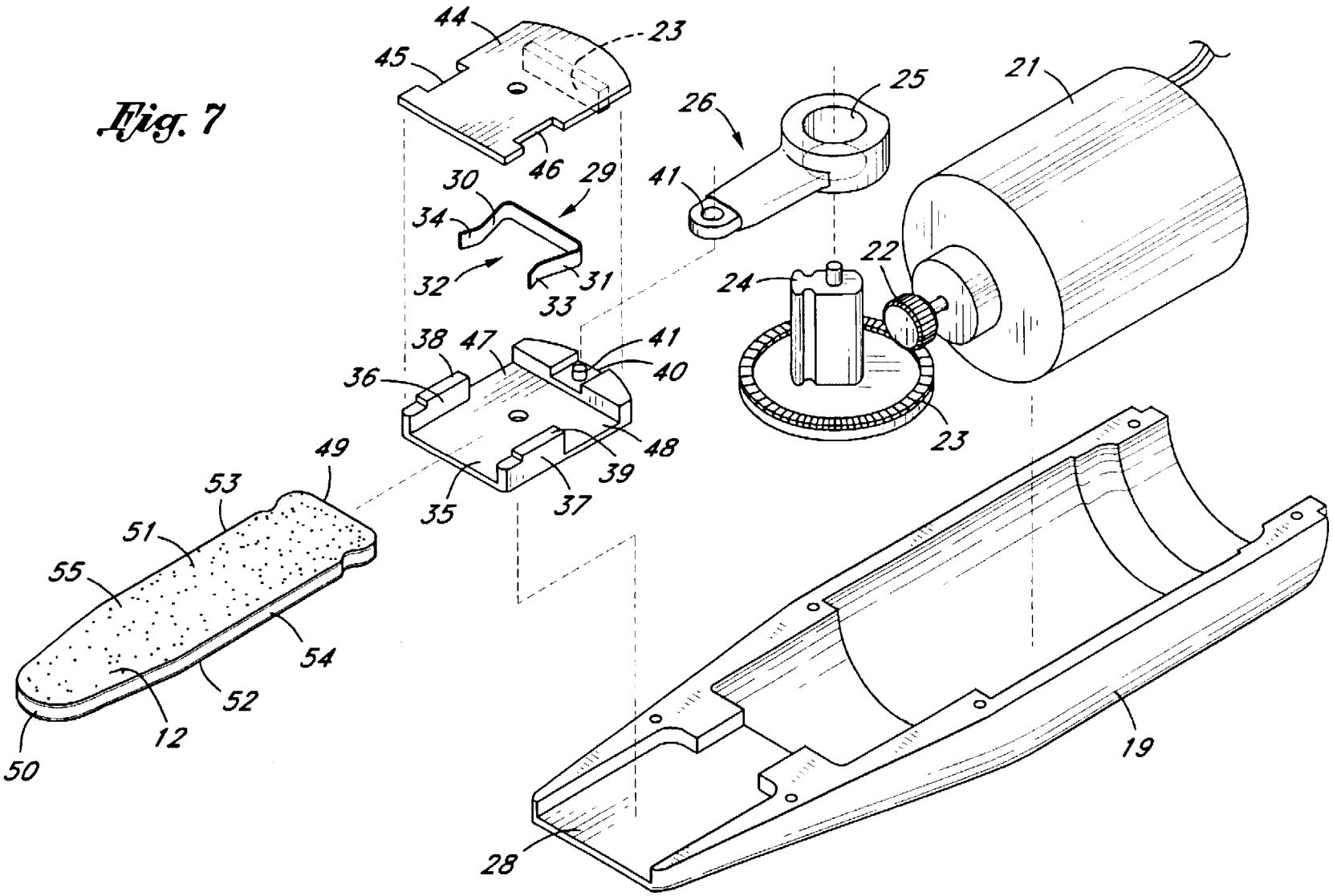
FIG. 7 is a further exploded perspective view of the elements shown in FIG. 6 of the file of FIG. 1.

Clip support enclosure 27 holds a generally U-shaped spring clip 29 which is shown best in FIG. 7. Spring clip 29 has a pair of arms 30 and 31 which are bent outwardly and provide an open end 32 of a spring clip 29. Arms 30 and 31 have inwardly facing protrusions or bends 33 and 34 which flex in and out as removable file 12 is inserted therein and pulled outwardly therefrom.

Clip support enclosure 27 as shown in FIG. 7 has a base 35, a pair of side walls 36 and 37, with upwardly extending tabs 38 and 39. Base 35 also has a recess 40 from which a pin 41 extends. Pin 41 fits in hole 42 at the outer end of reciprocating member 26. Thus, it can be seen as the motor rotates and the reciprocating member reciprocates that the base 35 will move inwardly and outwardly as well as spring clip 29. Spring clip 29 is held in place by a wall 43 in the top 44 of clip support enclosure 27. Top 44 has a pair of notches 45 and 46 which mate with tabs 38 and 39 to hold the top 44 from moving or sliding with respect to base 35. Thus, wall 43 holds the spring clip 29 as it reciprocates back and forth with reciprocating member 26. The side walls 36 and 37 have openings 47 and 48 which permit the arms 30 and 31 to flex inwardly and outwardly without being retained by the walls 36 and 37.

Removable file 12 is shaped so that it may be snapped into and out of the generally U-shaped spring clip 29. While a spring clip having a pair of inwardly bent arms is shown in the drawings, it is to be understood that the essential feature of the present invention is the provision of clip supporting enclosure 27 and that it would be possible to hold a file in the enclosure by simply having, for instance, an outwardly bowed spring along one side thereof. The generally U-shaped spring clip shown in the drawings, however, is the preferred embodiment.

The removable file 12 forms an important part of the present invention in that it is shaped so that it fits into and may be removed from spring clip 29. File 12 has an inner end 49, an outer end 50, a top surface 51, a bottom surface 52, a first side 53 and a second side 54. It can be seen that the top surface has an abrasive surface 55 which extends all the way to inner end 49. This abrasive surface does not, however, damage the generally rectangular shaped cavity 28 because it is completely surrounded by the clip support enclosure 27 which is fabricated from a "slippery" polymer. As the file is being reciprocated, it does not move with respect to the clip support enclosure since it is held in place by spring clip 29 within the enclosure and, thus, does not cause any significant amount of wear on the inner surface of the enclosure. The inner end 49 of file 12 is inserted within the open end 57 of clip support enclosure 27 which in turn is facing the open end 58 of housing 11. There should be about 0.005 difference in dimensions between the clip support enclosure 27 and the generally rectangular shaped cavity 28. This permits friction-free movement without unnecessary up and down movement of the file.

Figure 8:
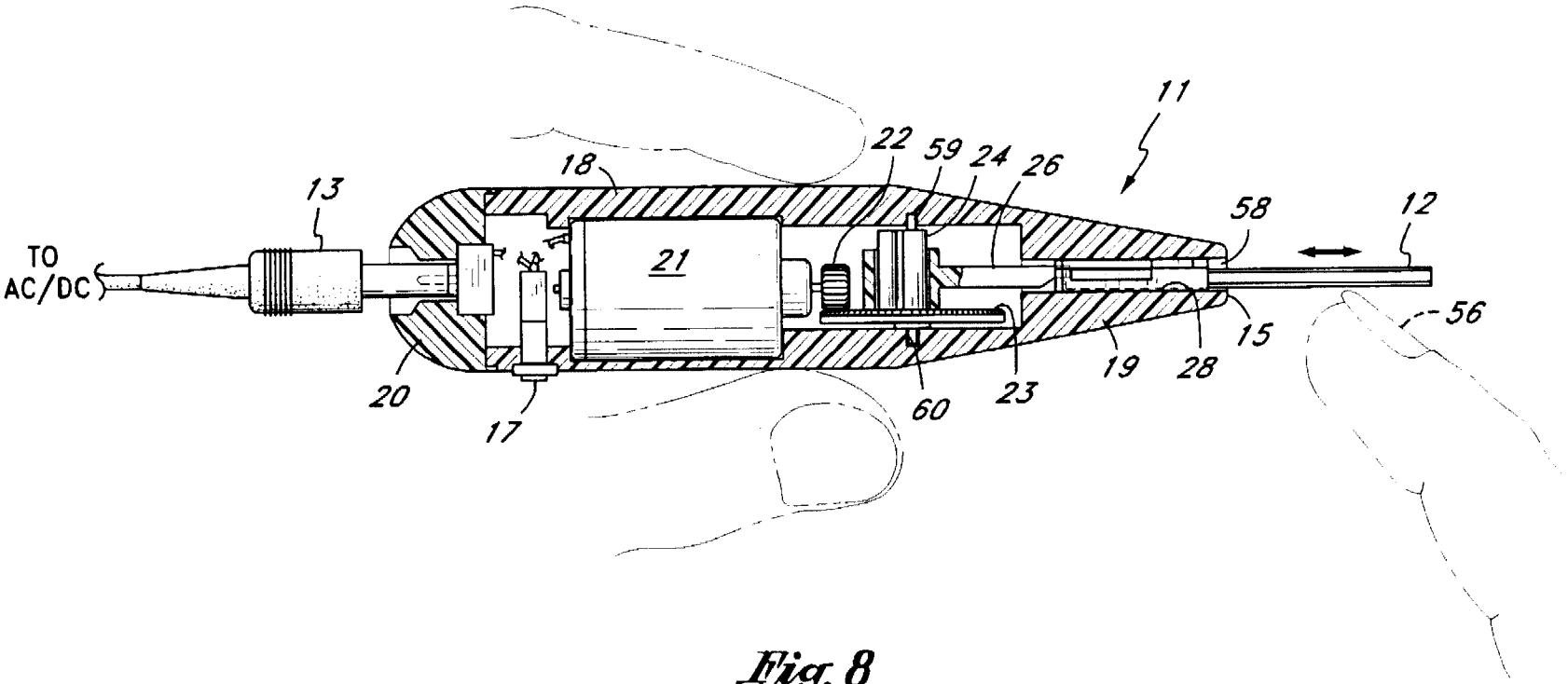
FIG. 8 is a cross-sectional side view of the file of FIG. 1.

The use of the electric abrasive file of the present invention as a nail file is indicated in FIG. 8 where the housing is shown in cross-sectional view. A fingernail 56 is shown in phantom view and it can also be seen that the user's hands can readily hold the housing 11. It can also be seen in FIG. 8 that the eccentric pin 24 and ring gear 23 are held by pins 59 and 60 held in cavities of the upper and lower housing parts 18 and 19 respectively.

The electric abrasive file of the present invention can, of course, be used for numerous uses, such as sharpening a knife, filing down rough edges on a model or craft project, or polishing small objects. It has a very small number of parts and is durable and economical to fabricate. It has been found that a DC motor operating at 8,000 RPM is highly successful which drives a 15 tooth spur gear which in turn drives a 50 tooth ring gear. The result is a smooth, relatively vibration-free tool of great durability.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. An electric abrasive file comprising:

a housing including a handle, said housing supporting an electric motor capable of driving a reciprocating member and said housing including an enclosure support cavity having an external opening at a file end of said housing;

a clip support enclosure having an open end, said enclosure being slidingly held in said enclosure support cavity, said clip support enclosure being controllably reciprocated by said reciprocating member;

a generally U-shaped spring clip held by said clip support enclosure having a pair of spring arms and a spring base, said spring arms surrounding an open spring end and said spring base being at a closed end respectively of said spring clip, said generally U-shaped spring clip having an inward bend and an outward bend at each end of said spring arms of said U-shaped spring clip said generally U-shaped spring clip being held in said enclosure so that its open spring end faces the open end of said clip support enclosure; and a file having an inner end, an outer end, a top surface and a bottom surface, a first side and a second side, an indentation in said first and second sides near said inner end, said inner end and said first and second sides adjacent said inner end being shaped to snap into and out of said spring clip whereby the file may be inserted into and removed from said clip support enclosure and into holding contact with said spring clip and reciprocated by the movement of said reciprocating member to provide a smoothing function to a work piece in contact with one of said top and bottom surfaces.

2. The electric abrasive file of claim 1 wherein said clip support enclosure has a base and a cap and when said base and cap are assembled there is a bar which holds the base of said spring clip in said clip support enclosure.

3. The electric abrasive file of claim 2 wherein said base and said cap are assembled, said clip support enclosure has a smooth top and a smooth bottom and a pair of sides.

4. The electric abrasive file of claim 3 wherein said cap has a pair of openings adjacent the sides of said cap and the base has a pair of tabs which fit into said openings of said cap so that the cap and base are fixed together when said clip support enclosure is held in said support cavity.

5. The electric abrasive file of claim 4 wherein said clip support enclosure has a pair of openings in sides thereof to permit an outward flexure of said spring arms of said spring clip.

6. The electric abrasive file of claim 1 wherein an intersection of said inner end of said file and the sides thereof are rounded.

7. The electric abrasive file of claim 1 wherein said clip support enclosure supports a pin which holds an end of said reciprocating member.

8. An electric file which holds an abrasive stick and causes it to reciprocate in and out when activated, said electric file and abrasive stick comprising:

a housing enclosing means for reciprocating a driven member, said housing having a file end;

a cavity having an opening at the file end of said housing;

a clip support enclosure comprising said driven member held within said cavity, said clip support enclosure having an outer surface which is slidingly retained in said cavity, said clip support enclosure holding two biased open arms, said clip support member having an open end positioned in front of the two open arms, said two arms being flexible and each having an inwardly facing protrusion thereon; and a file having an inner end, an outer end, a top surface, a bottom surface, a first side and a second side, said file having two outwardly facing indentations in each side thereof near the inner end, said file and said two outwardly facing indentations being shaped to mate with the inwardly facing protrusion of said biased open arm whereby said file may be pressed into the open end of said clip support member into the two biased open arms and held thereby while being reciprocated by said driven member and removed by pulling the file out of the biased open arms.

9. The electric file of claim 8 wherein said clip support member is fabricated from a polymer having a low coefficient of friction in said generally rectangular shaped cavity.

* * * * *